US011031711B2

(12) United States Patent
Chien et al.

(10) Patent No.: US 11,031,711 B2
(45) Date of Patent: Jun. 8, 2021

(54) ELECTRICAL CONNECTOR OF CHARGING DEVICE

(71) Applicant: Advanced Connectek Inc., New Taipei (TW)

(72) Inventors: Min-Lung Chien, New Taipei (TW); Fan-Cheng Huang, New Taipei (TW); Ying-Te Lin, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 15/931,521

(22) Filed: May 13, 2020

(65) Prior Publication Data

US 2020/0366013 A1 Nov. 19, 2020

(30) Foreign Application Priority Data

May 15, 2019 (TW) ..... 108206034

(51) Int. Cl.

| | |
|---|---|
| ***H01R 12/71*** | (2011.01) |
| ***H01R 13/42*** | (2006.01) |
| ***H01R 13/629*** | (2006.01) |
| ***H01R 13/6594*** | (2011.01) |
| ***H01R 12/55*** | (2011.01) |
| ***H01R 43/02*** | (2006.01) |
| ***H01R 12/72*** | (2011.01) |
| *H01R 107/00* | (2006.01) |

(52) U.S. Cl.

CPC ..... *H01R 12/716* (2013.01); *H01R 12/55* (2013.01); *H01R 12/724* (2013.01); *H01R 13/42* (2013.01); *H01R 13/629* (2013.01); *H01R 13/6594* (2013.01); *H01R 43/02* (2013.01); *H01R 2107/00* (2013.01)

(58) Field of Classification Search

CPC .... H01R 12/716; H01R 12/55; H01R 12/724; H01R 13/42; H01R 13/629; H01R 13/6594; H01R 43/02; H01R 210/00

See application file for complete search history.

(56) References Cited

U.S. PATENT DOCUMENTS

| | | | | |
|---|---|---|---|---|
| 9,214,769 | B2 * | 12/2015 | MacDougall | H01R 13/7032 |
| 9,640,925 | B2 * | 5/2017 | Tsai | H01R 25/006 |
| 9,647,393 | B2 * | 5/2017 | Tsai | H01R 13/6581 |
| 10,020,625 | B2 * | 7/2018 | Tsai | H01R 13/6585 |
| 10,218,134 | B2 * | 2/2019 | Tsai | H01R 13/6585 |
| 10,714,875 | B2 * | 7/2020 | Wan | H01R 12/724 |
| 2008/0194140 | A1 * | 8/2008 | Zhang | H01R 24/64 439/540.1 |
| 2016/0352049 | A1 * | 12/2016 | Long | H01R 13/659 |

* cited by examiner

*Primary Examiner* — Abdullah A Riyami
*Assistant Examiner* — Nader J Alhawamdeh
(74) *Attorney, Agent, or Firm* — JCIPRNET

(57) ABSTRACT

An electrical connector disposed on a circuit board is provided. The electrical connector includes a terminal set having a plurality of terminals, a first insulator, at least one second insulator, and a third insulator. Each of the terminals has a contact portion, a soldering portion connecting to the circuit board, and a bending portion connected between the contact portion and the soldering portion. The first insulator is structurally integrated with the contact portions. The second insulator is structurally integrated with the terminals and is located between the bending portions and the soldering portions. The third insulator is locked with the second insulator.

14 Claims, 8 Drawing Sheets

ELECTRICAL CONNECTOR OF CHARGING DEVICE

CROSS-REFERENCE TO RELATED APPLICATION

This application claims the priority benefit of Taiwan patent application serial no. 108206034, filed on May 15, 2019. The entirety of the above-mentioned patent application is hereby incorporated by reference herein and made a part of the specification.

BACKGROUND OF THE INVENTION

1. Field of the Invention

The present disclosure relates to a connector, and particularly relates to an electrical connector.

2. Description of Related Art

An electrical connector is a common component on an electronic device and can be connected with an adapted electrical connector on another electronic device to serve as a transmission medium for signals and power between the two electronic devices. An existing electrical connector, such as a USB (Universal Serial Bus) electrical connector, is the most widely and commonly used signal transmission and charging interface at present due to a hot plug function.

At present, the USB protocol additionally provides a specification of a Type-C electrical connector which can provide a 10 Gbps ultra-high data transmission rate, and plug-in interfaces of the Type-C electrical connector are symmetrical and can be forward and reversely plugged, so that the Type-C electrical connector is widely applied to various electronic devices, such as a notebook computer. According to different purposes, the USB Type-C electrical connector has different sizes. For example, when the Type-C electrical connector is used for a charging device, an obvious size difference is generated due to the state only used for signal transmission. Furthermore, the manufacturing process is complicated accordingly, the yield of the manufacturing process is often unstable due to the size difference, and the management difficulty to the manufacturing process is increased.

SUMMARY OF THE INVENTION

The present disclosure provides an electrical connector capable of increasing the availability of terminals by means of an assembled structure.

The electrical connector provided by the disclosure is suitable for being disposed on a circuit board. The electrical connector includes a terminal set having a plurality of terminals, a first insulator, at least one second insulator, and a third insulator. Each of the terminals includes a contact portion, a soldering portion connecting to the circuit board, and a bending portion connected between the contact portion and the soldering portion. The first insulator is structurally integrated with the contact portions. The second insulator is structurally integrated with the terminals and is located between the bending portions and the soldering portions. The third insulator is locked with the second insulator.

In an embodiment of the present disclosure, the terminal set is divided into a first group of terminals and a second group of terminals. The electrical connector includes a pair of second insulators, wherein one of the second insulators is structurally integrated with the first group of terminals, and the other one of the second insulators is structurally integrated with the second group of terminals.

In an embodiment of the present disclosure, the electrical connector further includes two separated metallic plates disposed on the first insulator and located between the first group of terminals and the second group of terminals, and the two metallic plates are partially and respectively exposed out two opposite sides of a tongue portion of the first insulator.

In an embodiment of the present disclosure, the first group of terminals includes at least one first grounding terminal arranged at the most lateral side, the second group of terminals includes at least one second grounding terminal arranged at the most lateral side, the second grounding terminal is corresponding to the first grounding terminal, and one of the separated metallic plates is located between the first grounding terminal and the second grounding terminal.

In an embodiment of the present disclosure, the height of the metallic plate relative to the circuit board is equal to or greater than 5 mm.

In an embodiment of the present disclosure, when the second insulator is not structurally integrated with the first group of terminals and the second group of terminals, the first group of terminals and the second group of terminals do not include the bending portions.

In an embodiment of the present disclosure, the bending portions are exposed between the first insulator and the third insulator.

In an embodiment of the present disclosure, the electrical connector further includes a shell which is assembled to the first insulator and the third insulator and covers the bending portions.

In an embodiment of the present disclosure, the third insulator is provided with a hollow portion, and the second insulators passes through the hollow portion and are locked in the third insulator.

In an embodiment of the present disclosure, an extending direction of the hollow portion is consistent with an extending direction of the soldering portion.

In an embodiment of the present disclosure, an extending direction of the hollow portion is consistent with an extending direction of the contact portion.

In an embodiment of the present disclosure, an extending direction of the hollow portion is orthogonal to an extending direction of the contact portion and an extending direction of the soldering portion.

In an embodiment of the present disclosure, a cross section of the third insulator at the hollow portion is of a "θ" shape, an "I" shape or an "E" shape.

In an embodiment of the present disclosure, the electrical connector is a receptacle electrical connector of a charging device.

In an embodiment of the present disclosure, the electrical connector is a USB Type-C connector.

In an embodiment of the present disclosure, the electrical connector further comprises an integrated metallic plate which is located between the first group of terminals and the second group of terminals of the terminal set, wherein the integrated metallic plate comprises the pair of existing metallic plates extended to each other to form the integrated metallic plate and the two opposed side edges of the integrated metallic plate are partially and respectively exposed out two opposite sides of a tongue portion of the first insulator.

Based on the above, the electrical connector includes the terminal set and the first insulator, the at least one second insulator and the third insulator which are matched with the terminal set, wherein the second insulator firstly is structurally integrated with the plurality of corresponding terminals respectively, the terminals are bent, and then, the second insulator and the third insulator are mutually locked, so that the electrical connector can be smoothly disposed on the circuit board. Therefore, the second insulator is located between the bending portions and the soldering portions, and then, the second insulator can be smoothly locked with the third insulator to form an assembled structure, thereby simplifying the structure and manufacturing process of the electrical connector, and further improving the situation that the existing manufacturing process cannot meet product requirements such as size difference.

To make the foregoing features and advantages of the present disclosure more comprehensible, embodiments are particularly provided below and described in detail with reference to the accompanying drawings.

DESCRIPTION OF THE EMBODIMENTS

Figure 1A:
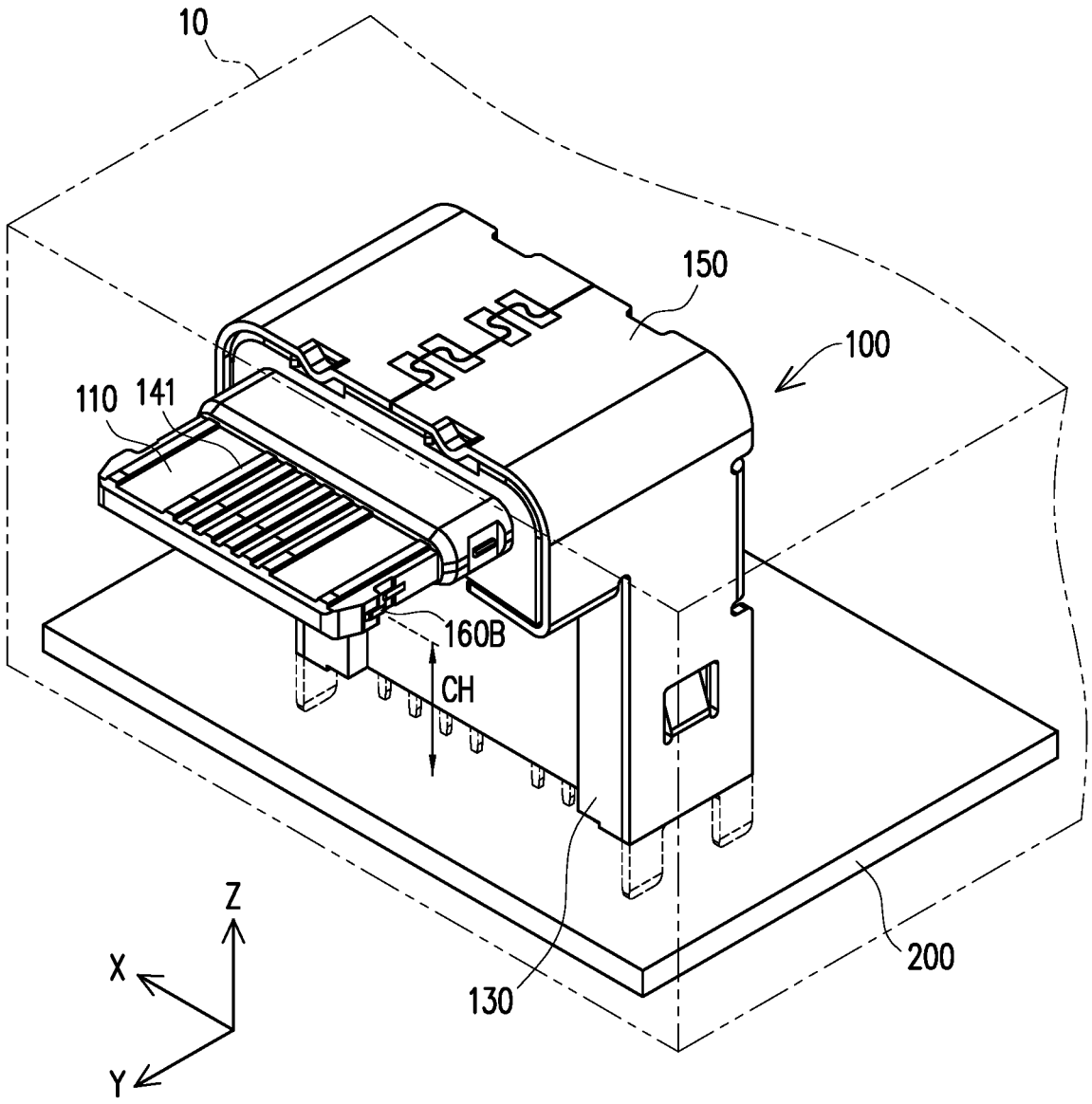
FIG. 1A is a schematic view of an electrical connector according to an embodiment of the present disclosure.
Figure 1B:
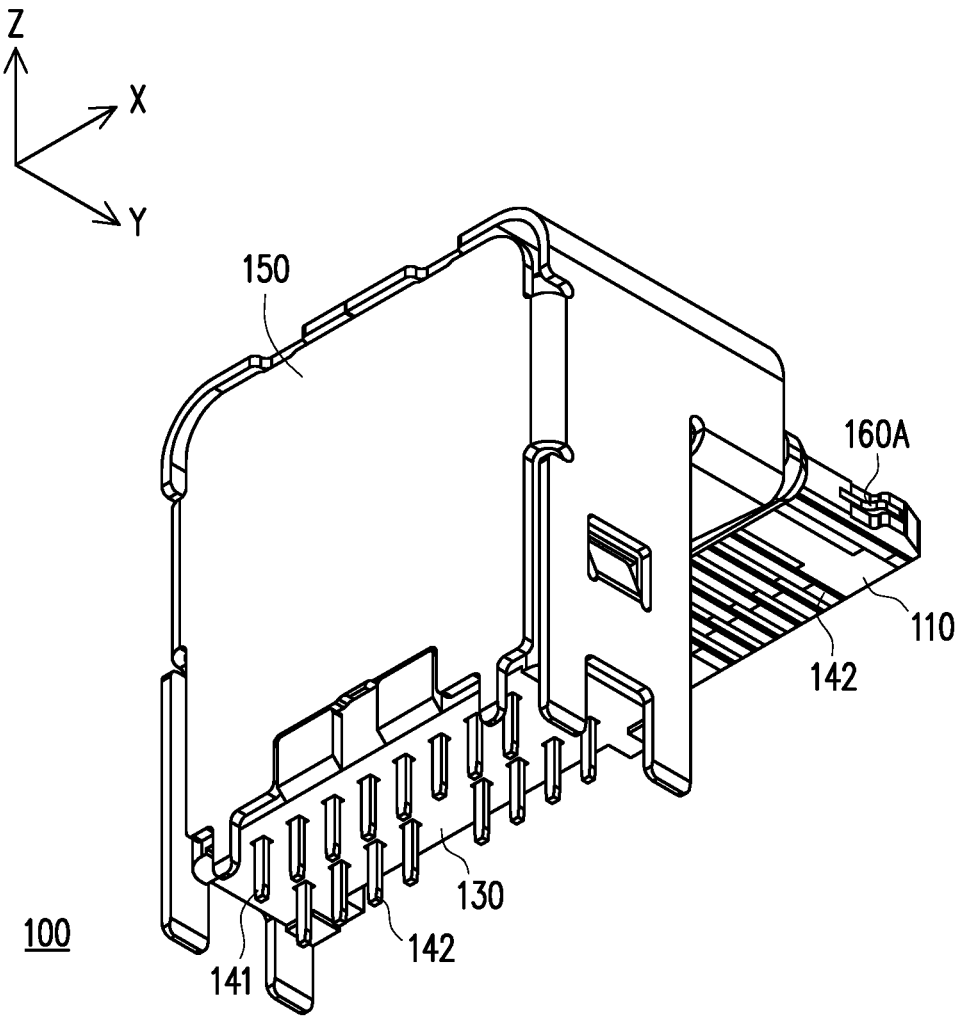
FIG. 1B shows an electrical connector in FIG. 1D from another perspective.
Figure 1C:
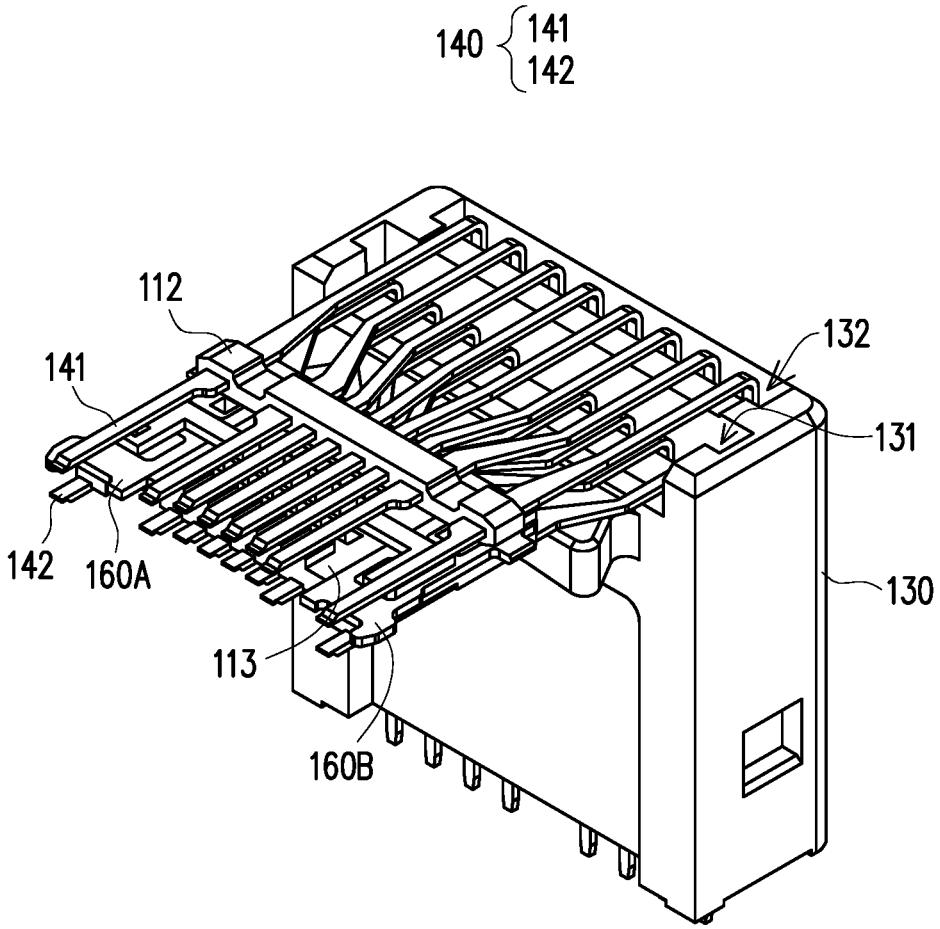
FIG. 1C is a schematic view of partial components of the electrical connector in FIG. 1A.

FIG. 1A is a schematic view of an electrical connector according to an embodiment of the present disclosure. FIG. 1B shows an electrical connector in FIG. 1D from another perspective. FIG. 1C is a schematic view of partial components of the electrical connector in FIG. 1A. The drawings simultaneously provide orthogonal coordinates X-Y-Z so as to facilitate the description of the related components. Referring to FIG. 1A, FIG. 1B and FIG. 1C, in the present embodiment, an electrical connector 100 is, for example, a USB Type-C connector and is disposed (soldered) on a circuit board 200 to serve as a receptacle electrical connector. Further, the electrical connector 100 of the present embodiment serves as a receptacle electrical connector of a charging device 10 to output electric power.

The electrical connector 100 includes a first insulator 110, a terminal set 140, a third insulator 130, a metallic shell 150 and two metallic plates (i.e. shielding members) 160A and 160B. The terminal set 140 includes a first group of terminals 141 and a second group of terminals 142 which are respectively disposed correspondingly up and down along the Z-axis on an upper surface of a tongue portion of the first insulator 110 and a lower surface of the tongue portion of the first insulator 110, so that the terminals A1 to A8 and B1 to B8 of the terminal set 140 form a connecting interface butted with an external electrical connector (plug electrical connector, not shown herein) at the upper surface of the tongue portion of the first insulator 110 or the lower surface of the tongue portion of the first insulator 110. The two metallic plates (i.e. shielding members) 160A and 160B are disposed inside the first insulator 110 and are partially exposed from the tongue portion of the first insulator 110 along two opposite sides of the X-axis, thereby serving as the reinforced structure of the first insulator 110 and further providing a grounding effect when the electrical connector 100 is butted with the external electrical connector.

Furthermore, the terminals A1 to A8 and B1 to B8 of the terminal set 140 are firstly bent and inserted into the third insulator 130 before being soldered to the circuit board 200, and the metallic shell 150 is assembled to the first insulator 110 and the third insulator 130 and covers the portions of the terminal set 140 which is exposed from the first insulator 110 and the third insulator 130. As shown in FIG. 1A and FIG. 1B, a bottom bulge of the metallic shell 150 serves as a locating structure for the electrical connector 100 to be assembled to the circuit board 200. In the present embodiment, the metallic shell 150 can achieve the effects of shielding the portion of the terminal set 140 exposed out of the insulator and being located on the circuit board 200, and can achieve a grounding effect by being electrically conducted to the circuit board 200.

Figure 2:
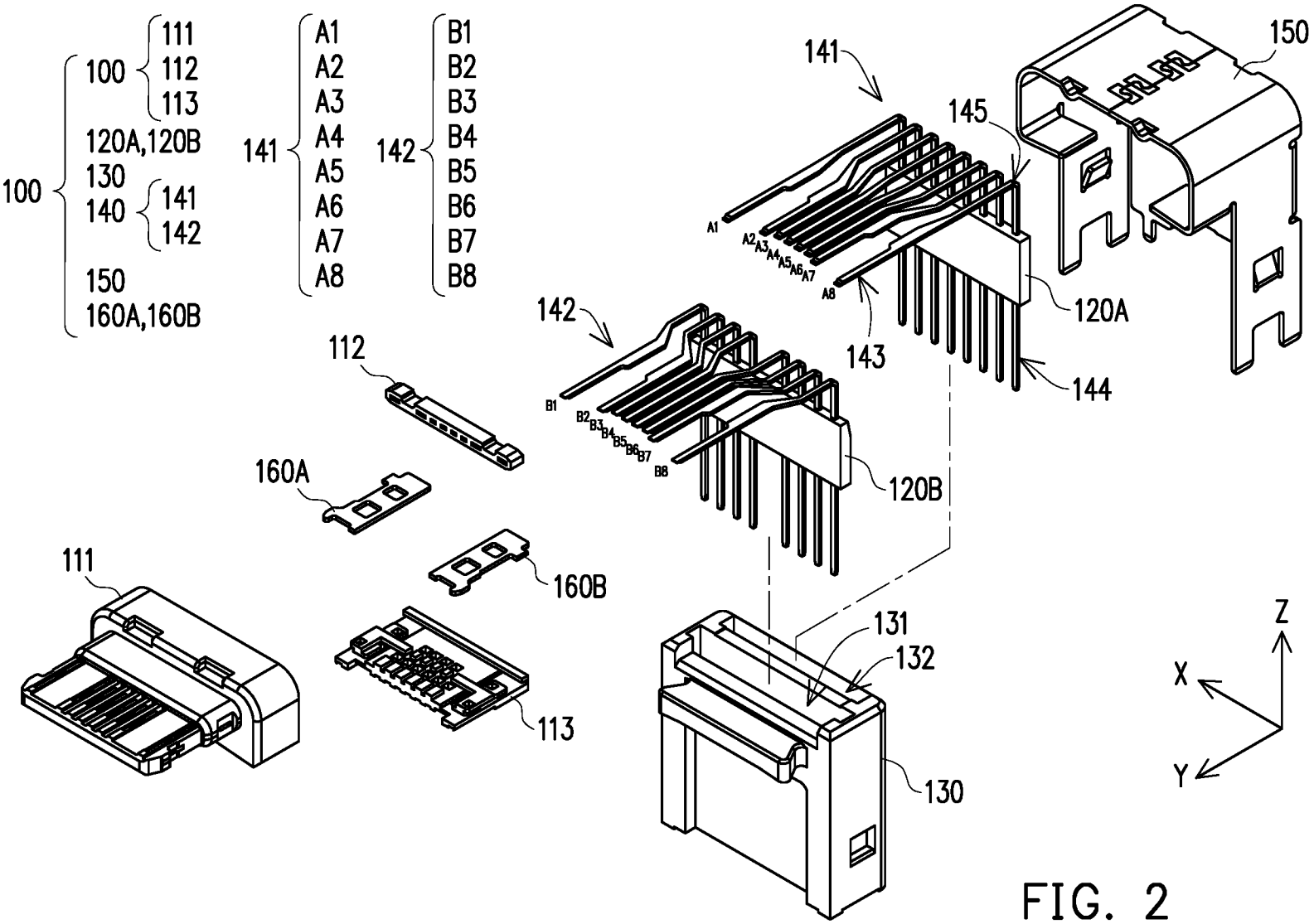
FIG. 2 is an exploded view of the electrical connector in FIG. 1A.

FIG. 2 is an exploded view of the electrical connector in FIG. 1A. Referring to FIG. 2, in detail, the electrical connector 100 of the present embodiment also includes second insulators 120A and 120B, and the terminals A1 to A8 of the first group of terminals 141 and the terminals B1 to B8 of the second group of terminals 142 have the similar structure. Taking a terminal A8 shown in FIG. 2 as an example, the terminal A8 includes a contact portion 143, a bending portion 145, and a soldering portion 144, wherein the contact portion 143 is structurally integrated with the first insulator 110, the soldering portion 144 is used for being soldered to the circuit board 200, and the bending portion 145 is connected between the contact portion 143 and the soldering portion 144. Equivalently, the contact portion 143 extends along the Y-axis, passes through the bending portion 145, and is then changed to the soldering portion 144 extending along the Z-axis. Before the metallic shell 150 is assembled to the first insulator 110 and the third insulator 130, the bending portion 145 is exposed between the first insulator 110 and the third insulator 130, and the bending portion 145 is covered until the metallic shell 150 is assembled. Equivalently, for the terminal set 140, the second insulators 120A and 120B are respectively structurally integrated with the first group of terminals 141 and the second group of terminals 142 and are located between the bending portion 145 and the soldering portion 144.

Referring to FIG. 2 and FIG. 1C, the third insulator 130 includes hollow portions 131 and 132 extending along the Z-axis, i.e., extending directions of the hollow portions 131 and 132 are consistent with an extending direction of the soldering portions 144. The second insulators 120B and 120A pass through the hollow portions 131 and 132 and are inserted into the third insulator 130, and the second insulators 120A and 120B are locked with the third insulator 130. Herein, the structure in which the components are locked to each other is not limited, and can be obtained from the prior art. As shown in FIG. 1B, the soldering portions 144 of the terminals A1 to A8 and B1 to B8 penetrate out of the bottom of the third insulator 130 so as to be conveniently arranged on the circuit board 200 in a penetrating way.

It should be noted that the first insulator 110 includes components 111, 112 and 113, and the terminals A1 to A8 and B1 to B8 of the terminal set 140 are mutually structurally integrated with the components 111, 112 and 113 at the contact portions 143. As shown in FIG. 2, the first insulator 110 is split into different components so as to be mutually assembled with the terminals A1 to A8 and B1 to B8. However, in other embodiments, the terminals A1 to A8 and B1 to B8 of the terminal set 140 can also be mutually structurally integrated with the first insulator 110 at the contact portions 143 by means of the insert molding technology.

Furthermore, as shown in FIG. 2, because the electrical connector 100 of the present embodiment is used for charging without transmitting high-frequency signals, the pair of metallic plates (i.e. shielding members) 160A and 160B of the present embodiment can save a large area and are only located between the grounding terminals. In other words, in the first group of terminals 141 of the present embodiment, the terminals A1 and A8 arranged at the most lateral sides are grounding terminals; in the second group of terminals 142, the terminals B1 and B8 arranged at the most lateral sides are grounding terminals; and the metallic plate 160A is located between the terminals A1 and Bl, and the metallic plate 160B is located between the terminals A8 and B8. Therefore, the manufacturing cost of the electrical connector 100 can be effectively saved. Of course, in another embodiment not shown, when the electrical connector needs to transmit high-frequency signals, the pair of existing metallic plates 160A and 160B extend to each other to form an integrated metallic plate which is located between the first group of terminals 141 and the second group of terminals 142 of the terminal set 140, thereby achieving the needed shielding effect.

Referring to FIG. 1A, because the electrical connector 100 is used for power output of the charging device 10, the electrical connector 100 and the circuit board 200 keep a certain height along the Z-axis. Taking the electrical connector 100 of the present embodiment as an example, the metallic plate 160A (or 160B) has a center height CH relative to the upper board surface of the circuit board 200, and the center height CH is greater than or equal to 5 mm.

As mentioned above, compared with an electrical connector only used for signal transmission in the prior art, a higher center height CH is not needed. In other words, the center height CH of the existing electrical connector only used for signal transmission is approximately equal to or less than 4 mm. However, because the electrical connector 100 of the present embodiment has a higher center height CH, in the manufacturing process of the electrical connector 100, in order to avoid defects due to a too large size when the terminals and the insulators are combined (by means of insert molding), the present embodiment adopts a mode different from the prior art so as to simplify the manufacturing process and optimize the structure of the terminals and the insulators.

Figure 3:
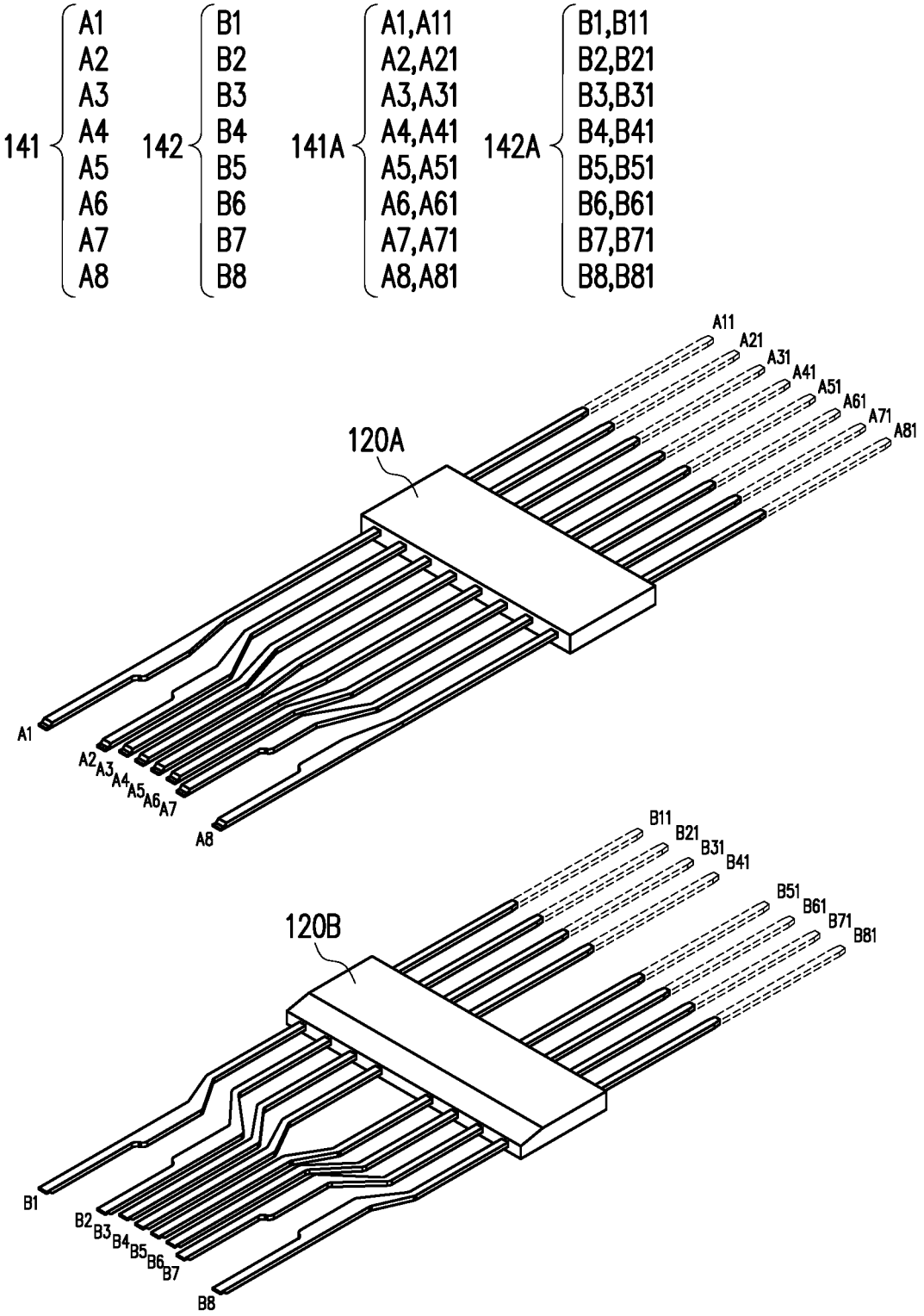
FIG. 3 is a schematic view of a terminal set in FIG. 2 before manufacturing.

FIG. 3 is a schematic view of a terminal set in FIG. 2 before manufacturing. Referring to FIG. 2 and FIG. 3, different from the prior art that the terminals are bent and then structurally integrated with the insulators, the terminal set 140 of the present embodiment is characterized in that the needed terminals are firstly arranged and then combined respectively by means of the second insulator 120A or 120B. As shown in FIG. 3, a terminal raw material 141A includes terminals A1 to A8 and extension portions A11 to A81 thereof (FIG. 3, a structure shown by dotted lines), and a terminal raw material 142A includes terminals B1 to B8 and extension portions B11 to B81 thereof (FIG. 3, a structure shown by dotted lines). In other words, according to the process as shown in FIG. 3, the needed terminals are firstly arranged and gathered by means of the second insulators 120A and 120B to form prototypes of the first group of terminals 141 and the second group of terminals 142 (namely the terminal raw material 141A and the terminal raw material 142A).

Subsequently, the prototypes are reprocessed according to the requirement (namely the center height CH needed by the electrical connector 100). The present embodiment can refer to the conversion process from FIG. 3 to FIG. 2. After the needed center height CH is determined, the terminal raw material 141A and the terminal raw material 142A are respectively cut and bent, wherein the cutting operation is to cut the unneeded extension portions A11 to A81 and extension portions B11 to B81 and bend the terminals A1 to A8 and B1 to B8 so as to enable the bending portion 145 of each terminal to be located between the second insulators 120A and 120B and the contact portions 143, thereby forming the first group of terminals 141 and the second group of terminals 142 as shown in FIG. 2. On the other hand, when the second insulators 120A and 120B are not combined with the first group of terminals 141 and the second group of terminals 142, the first group of terminals 141 and the second group of terminals 142 have no need of the bending portions 145. It should be mentioned that in another embodiment, the terminal raw material 141A and the terminal raw material 142A can be combined and gathered together by an integrated second insulator.

The manufacturing process can effectively save the use of the terminal materials and optimize the application scope of the terminal materials. Compared with the manufacturing process of first bending and then insert molding in the prior art, the sizes of the terminals are determined in advance, so that the terminals are discarded when not meeting the use requirements. Relatively, according to the present disclosure, the needed terminals A1 to A8 and B1 to B8 are firstly gathered by means of the second insulators 120A and 120B to form the terminal raw material 141A and the terminal raw material 142A, after the needed size (such as center height CH) of the electrical connector 100 is determined, the terminals are correspondingly trimmed and bent, therefore, before the terminals are bent, the terminal raw material 141A and the terminal raw material 142A are substantially applicable to various specifications of electrical connectors.

Figure 4A:
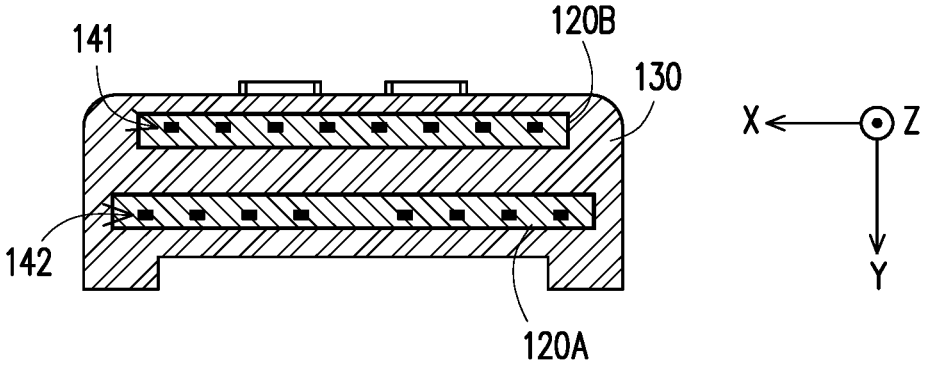
FIG. 4A is a cross-sectional view of the electrical connector in FIG. 1A.
Figure 4B:
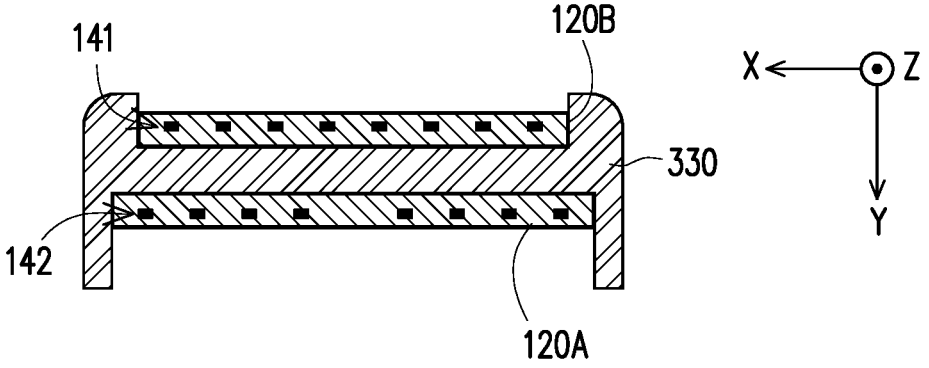
FIG. 4B is a cross-sectional view of an electrical connector according to another embodiment of the present disclosure.
Figure 4C:
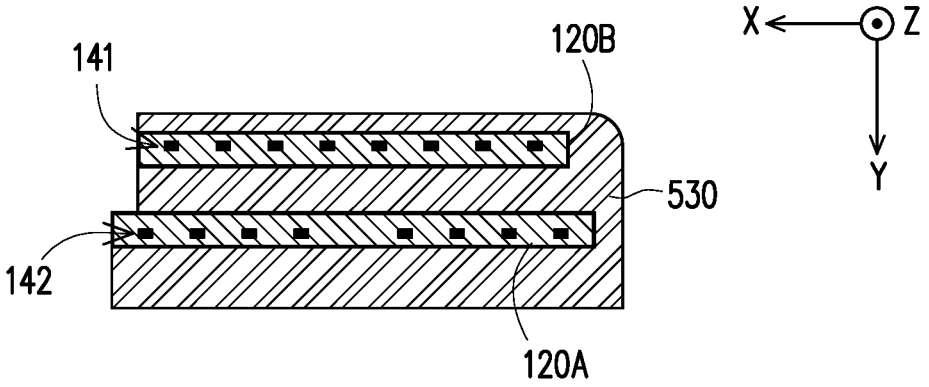
FIG. 4C is a cross-sectional view of an electrical connector according to another embodiment of the present disclosure.

FIG. 4A is a cross-sectional view of the electrical connector in FIG. 1A. FIG. 4B is a cross-sectional view of an electrical connector according to another embodiment of the present disclosure. FIG. 4C is a cross-sectional view of an electrical connector according to another embodiment of the present disclosure. Referring to FIG. 4A, because the second insulators 120A and 120B are inserted and locked in the third insulator 130 along the Z-axis, the second insulators 120A and 120B are coated by the third insulator 130, and the cross section of the third insulator 130 at the hollow portions 131 and 132 (marked in FIG. 2) is of a "θ" shape. Furthermore, referring to FIG. 4B, in the present embodiment, the hollow portions of the third insulator 330 extend along the Z-axis, but the openings of the hollow portions respectively face towards the positive Y-axis direction and the negative Y-axis direction (i.e., the direction of the openings is consistent with the extending direction of the contact portions 143), so that the second insulators 120A and 120B are inserted into the third insulator 330 still along the Z axis, and the cross section of the third insulator 330 at the hollow portions is of an "I" shape. Furthermore, as shown in FIG. 4C, the openings of the hollow portions of the third insulator 530 face towards the positive X-axis direction, so that the second insulators 120A and 120B are inserted and locked in the third insulator 530 along the X-axis, and the cross section of the third insulator 530 at the hollow portions is of an inverted "E" shape (or "E" shape). At this moment, the extending direction of the hollow portions is simultaneously orthogonal to the extending direction of the contact portions 143 and the extending direction of the soldering portions 144.

Figure 5A:
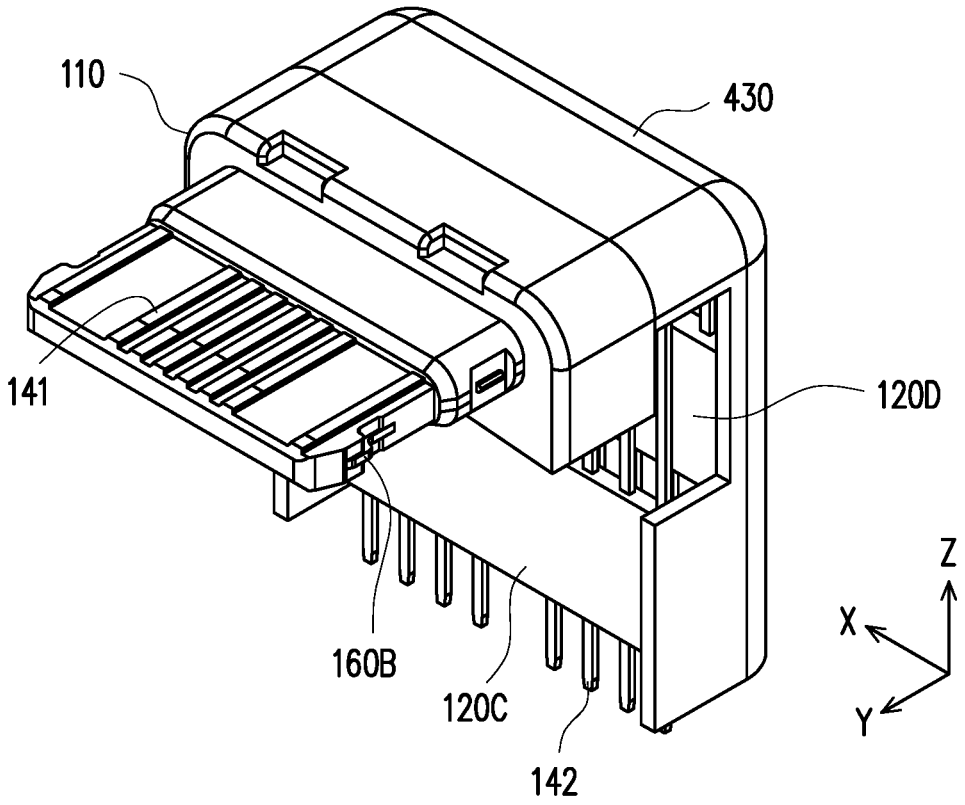
FIG. 5A is a schematic view of an electrical connector according to another embodiment of the present disclosure.
Figure 5B:
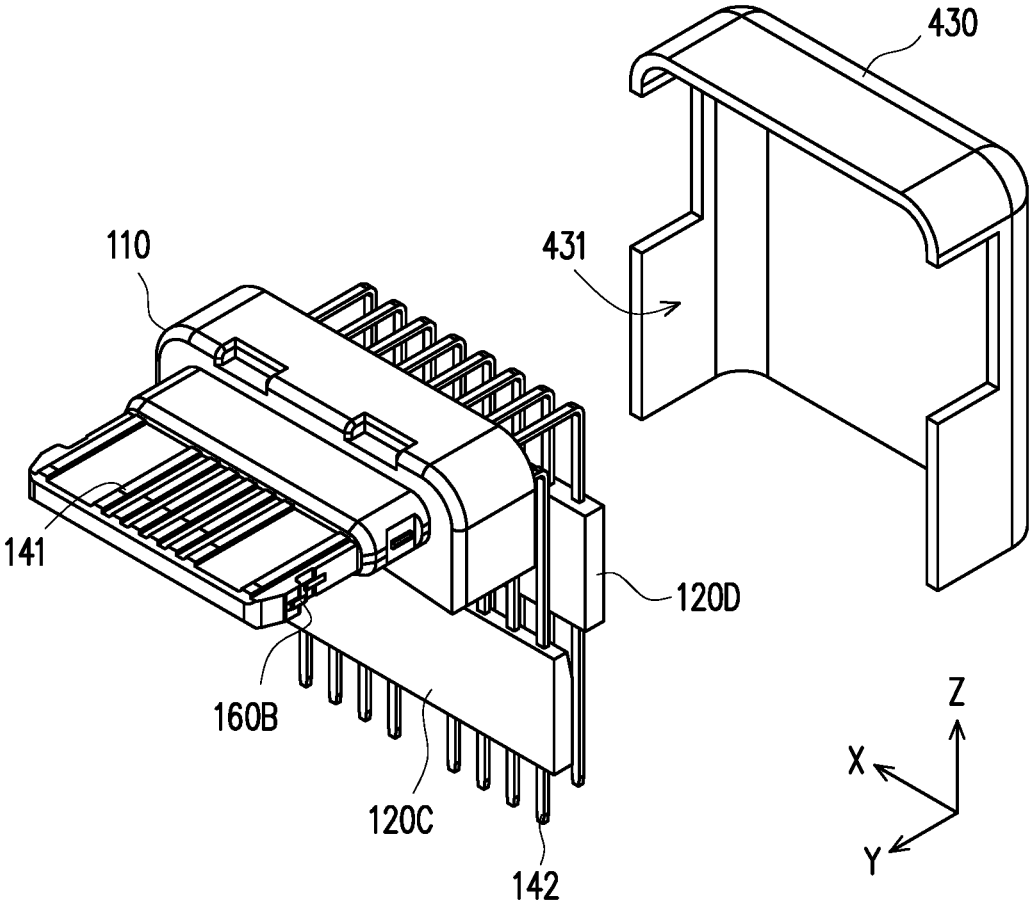
FIG. 5B is an assembly schematic view of partial components of the electrical connector in FIG. 5A.

On the other hand, FIG. 5A is a schematic view of an electrical connector according to another embodiment of the present disclosure. FIG. 5B is an assembly schematic view of partial components of the electrical connector in FIG. 5A. Simultaneously referring to FIG. 5A and FIG. 5B, different from the foregoing embodiments, the opening of the hollow portion 431 of the third insulator 430 faces towards the Y-axis direction, so that the terminal set 140 needs to pass through the hollow portion 431 along the Y-axis so as to be assembled to the third insulator 430, wherein the second insulators 120C and 120D have a height difference along the Z-axis to facilitate mutual locking with the third insulator 430 respectively, and other components are similar to those in the foregoing embodiments and are not described repeatedly.

In conclusion, in the above embodiments of the present disclosure, the electrical connector includes the terminal set and the first insulator, the at least one second insulator and the third insulator which are matched with the terminal set, wherein the second insulators is firstly structurally integrated with the plurality of corresponding terminals respectively to form the terminal raw materials which are not bent, the terminal raw materials are cut and bent after the size of the electrical connector is determined, and finally, the second insulators and the third insulator are mutually locked, so that the electrical connector can be smoothly disposed on the circuit board. Therefore, the second insulators are located between the bending portions and the soldering portions, and then, the second insulators can be smoothly locked with the third insulator to form an assembled structure, thereby simplifying the structure and manufacturing process of the electrical connector.

Further, in the manufacturing process of the electrical connector manufactured by an integrally formed structure, once semi-finished products do not meet the requirements of sizes, the semi-finished products are only discarded and cannot be used for other purposes, thereby increasing the material loss. However, the present disclosure adopts the terminal raw materials formed by the second insulators and the unbent terminals, and the terminal raw materials are reprocessed after the size is determined, thereby effectively increasing the operating flexibility of the manufacturing process, and simultaneously increasing the applicability of the semi-finished products (the terminal raw materials).

In other words, the structure and manufacturing process of the electrical connector of the present disclosure are simplified by means of the assembled components (the second insulators and the third insulator), thereby improving the situation that the prior art cannot meet product requirements such as size difference.

Although the present disclosure is disclosed above by using the embodiments, the embodiments are not intended to limit the present disclosure. A person of ordinary skill in the art can make some variations and polishes without departing from the spirit and scope of the present invention. Therefore, the protection scope of the present disclosure should be subject to the scope of the following claims.

What is claimed is:

1. An electrical connector suitable for being disposed on a circuit board, comprising: a terminal set, comprising a plurality of terminals, wherein each of the terminals comprises a contact portion, a soldering portion connecting to the circuit board, and a bending portion connected between the contact portion and the soldering portion; a first insulator, structurally integrated with the contact portions; at least one second insulator, structurally integrated with the terminals and located between the bending portions and the soldering portions; and a third insulator, locked with the second insulator; wherein the terminal set is divided into a first group of terminals and a second group of terminals, and the electrical connector comprises a pair of second insulators, wherein one of the second insulators is structurally integrated with the first group of terminals, and the other one of the second insulators is structurally integrated with the second group of terminals, further comprising two separated metallic plates disposed on the first insulator and located between the first group of terminals and the second group of terminals, wherein the two separated metallic plates are partially and respectively exposed out two opposite sides of a tongue portion of the first insulator.

2. The electrical connector according to claim 1, wherein the first group of terminals comprises at least one first grounding terminal arranged at the most lateral side, the second group of terminals comprise at least one second grounding terminal arranged at the most lateral side, the second grounding terminal is corresponding to the first grounding terminal, and one of the separated metallic plates is located between the first grounding terminal and the second grounding terminal.

3. The electrical connector according to claim 1, wherein the height of the metallic plate relative to the circuit board is equal to or greater than 5 mm.

4. The electrical connector according to claim 1, wherein when the pair of second insulators is not structurally integrated with the first group of terminals and the second group of terminals, the first group of terminals and the second group of terminals do not comprise the bending portions.

5. The electrical connector according to claim 1, wherein the bending portions are exposed between the first insulator and the third insulator.

6. The electrical connector according to claim 1, further comprising a shell assembled to the first insulator and the third insulator to cover the bending portions.

7. The electrical connector according to claim 1, wherein the third insulator has a hollow portion, and the second insulator passes through the hollow portion and are locked in the third insulator.

8. The electrical connector according to claim 7, wherein the extension direction of the hollow portion is consistent with the extension direction of the soldering portions.

9. The electrical connector according to claim 7, wherein an extending direction of the hollow portion is consistent with an extending direction of the contact portion.

10. The electrical connector according to claim 7, wherein an extending direction of the hollow portion is orthogonal to an extending direction of the contact portion and an extending direction of the soldering portion.

11. The electrical connector according to claim 7, wherein a cross section of the third insulator at the hollow portion is of a "θ" shape, an "I" shape or an "E" shape.

12. The electrical connector according to claim 1 is a receptacle electrical connector of a charging device.

13. The electrical connector according to claim 1 is a USB Type-C connector.

14. The electrical connector according to claim 1, further comprising an integrated metallic plate which is located between the first group of terminals and the second group of terminals of the terminal set, wherein the integrated metallic plate comprises the pair of existing metallic plates extended to each other to form the integrated metallic plate and the two opposed side edges of the integrated metallic plate are partially and respectively exposed out two opposite sides of a tongue portion of the first insulator.

* * * * *